US005730229A

United States Patent [19]

Nilsson

[11] Patent Number: 5,730,229

[45] Date of Patent: Mar. 24, 1998

[54] APPARATUS FOR COACTION WITH MACHINES SUCH AS WHEEL-MOUNTED LOADERS AND THE LIKE TO EQUALIZE THE EFFECT OF IRREGULARITIES IN A BASE SURFACE

[76] Inventor: Lennart Nilsson, Wolfsgatan 2, S-962 32, Jokkmokk, Sweden

[21] Appl. No.: 433,442

[22] PCT Filed: Nov. 5, 1993

[86] PCT No.: PCT/SE93/00931

§ 371 Date: Feb. 12, 1996

§ 102(e) Date: Feb. 12, 1996

[87] PCT Pub. No.: WO94/11584

PCT Pub. Date: May 26, 1994

[30] Foreign Application Priority Data

Nov. 11, 1992 [SE] Sweden ..... 9203368

[51] Int. Cl.[6] ..... E02F 3/12

[52] U.S. Cl. ..... 172/832; 172/834

[58] Field of Search ..... 172/832, 834, 172/783, 815, 273

[56] References Cited

U.S. PATENT DOCUMENTS

| | | | |
|---|---|---|---|
| 1,585,633 | 5/1926 | Agnew | 172/832 |
| 2,008,908 | 7/1935 | Gustafson | 172/832 X |
| 2,444,321 | 6/1948 | Wooldridge | 172/834 |
| 2,529,007 | 11/1950 | Ferguson | 172/834 X |
| 2,692,447 | 10/1954 | Klages | 172/832 X |
| 2,698,491 | 1/1955 | Felt | 172/832 X |
| 2,962,947 | 12/1960 | MacDonald | 172/832 X |
| 3,011,275 | 12/1961 | White, Jr. | 172/781 |
| 3,027,662 | 4/1962 | Cunningham, Jr. | 172/832 X |
| 3,454,109 | 7/1969 | Roberts | 172/781 |
| 3,791,457 | 2/1974 | Hanser et al. | 172/781 |

*Primary Examiner*—Terry Lee Melius
*Assistant Examiner*—Christopher J. Novosad
*Attorney, Agent, or Firm*—John Lezdey

[57] ABSTRACT

The present invention relates to an apparatus for use in conjunction with a machine, such as a wheel-mounted loader, road planing machine or the like, to equalize the effect of ground-surface irregularities. The apparatus includes a frame disposed in the movement direction of the machine and a planing tool. The apparatus also includes a bogie-assembly which is mounted on the front end of the frame and extends parallel to the frame. The bogie-assembly includes two pivot wheels and a linking device which is pivotally mounted between the frame and an intermediate unit connected to the planing tool.

12 Claims, 7 Drawing Sheets

APPARATUS FOR COACTION WITH MACHINES SUCH AS WHEEL-MOUNTED LOADERS AND THE LIKE TO EQUALIZE THE EFFECT OF IRREGULARITIES IN A BASE SURFACE

BACKGROUND OF THE INVENTION

1. Field of the Invention

The present invention relates to a apparatus for coaction with machines or the like to equalize the effect of irregularities in a base or ground surface.

2. Description of the Prion Art

SE-B-459017 discloses an auxiliary tool for wheel-mounted loaders and like machines. The auxiliary tool (39) includes a frame (2) which can be detachably connected to the machine and which carries a tool or implement (3), for instance a planing or grading tool. A transverse bogie-beam (23) is fitted to the frame (2), said bogie-beam carrying at least one pivot wheel (21). The auxiliary tool (39) is also a control-independent unit.

One serious drawback with the auxiliary tool disclosed in SE-B-459017 and also with conventional road graders is that as a result of the construction of present day tools, any irregularity in the ground surface will be transmitted essentially to the planing tool, which means that a large part of the irregularity will remain in the ground surface subsequent to planing said surface, unless the machine operator is very skillful. If the machine operator is highly skilled, she/he will be able to compensate for surface irregularities, by manoeuvering the planing tool with the aid of different hydraulic piston-cylinder devices which influence the planing tool settings. Since it is necessary for the machine operator to constantly finely manoeuver the planing tool, it takes a relatively long time to achieve a satisfactory result

SUMMARY OF THE INVENTION

The aforesaid problems are solved with an apparatus intended for coaction with such machines as wheel-mounted loaders, road planing machines or the like to equalize the effect of irregularities in a ground surface in accordance with the features set forth in the characterizing clause of claim 1. The ability of the apparatus to equalize the effect of irregularities in ground surfaces is achieved by virtue of the fact that the apparatus includes a bogie-means which is arranged at the front end of the frame, parallel with said frame, and which includes two pivot wheels, and further includes a link device which is pivotally mounted between the frame and an intermediate unit connected to the planing tool.

BRIEF DESCRIPTION OF THE DRAWINGS

The invention will now be described in more detail with reference to an exemplifying embodiment thereof and also with reference to the accompanying drawings, in which.

DESCRIPTION OF THE PREFERRED EMBODIMENTS

Figure 1:
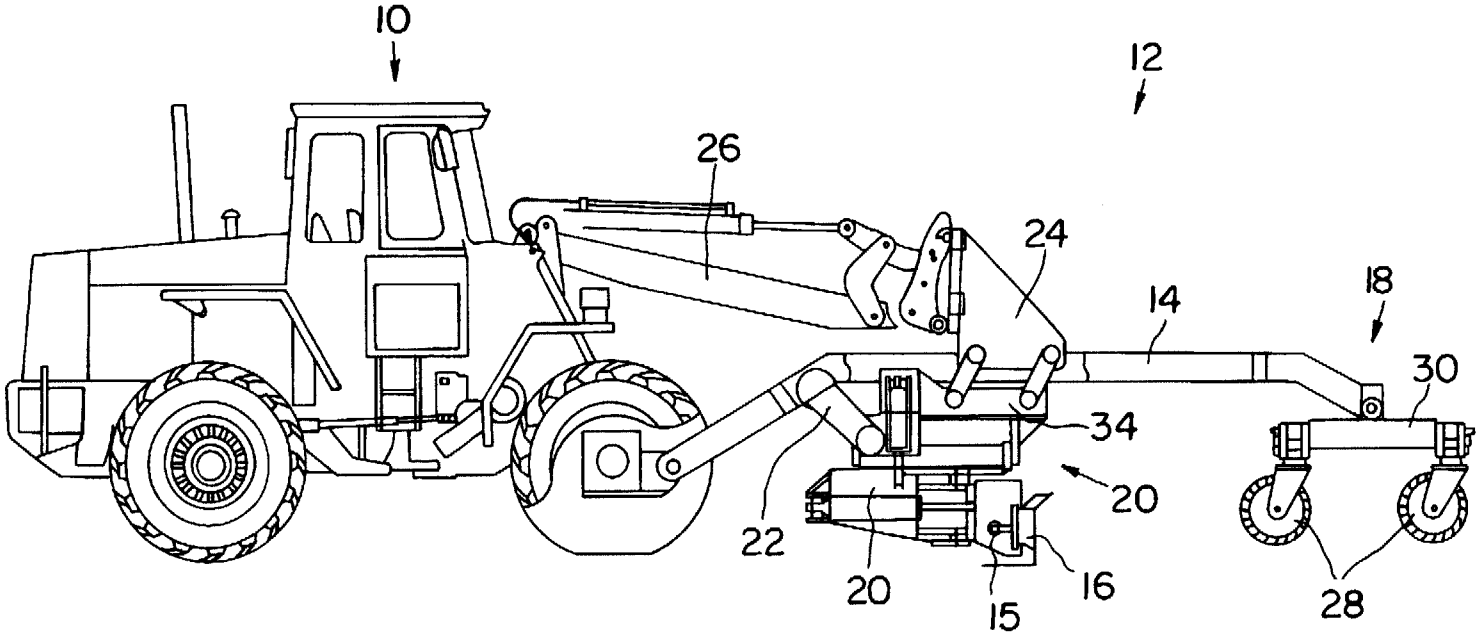
FIG. 1 is a side view of a machine equipped with an apparatus constructed in accordance with the invention.
Figure 2:
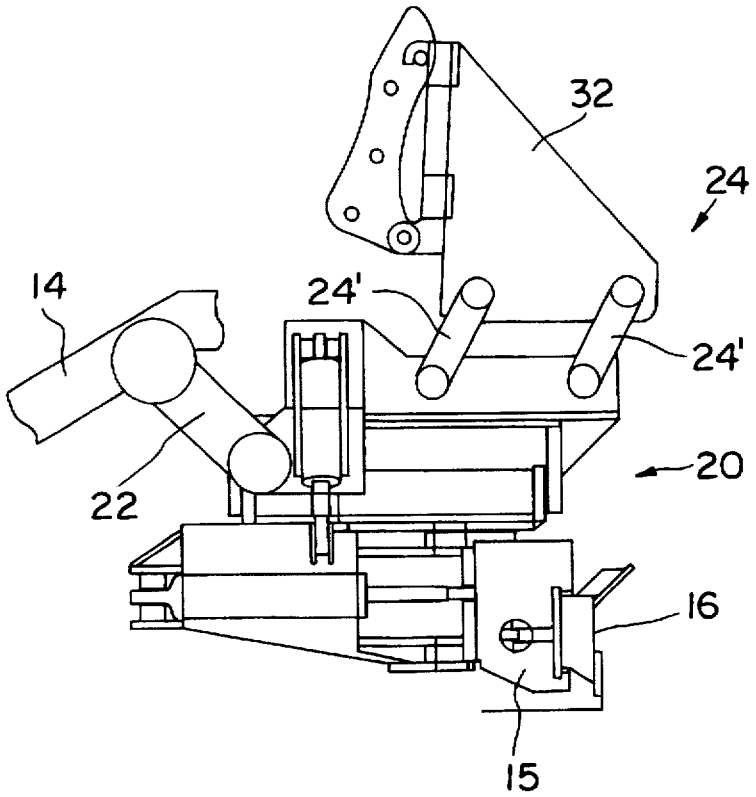
FIG. 2 is a side view which illustrates the construction of the planer yoke in larger scale, said yoke forming part of the inventive apparatus.
Figure 4:
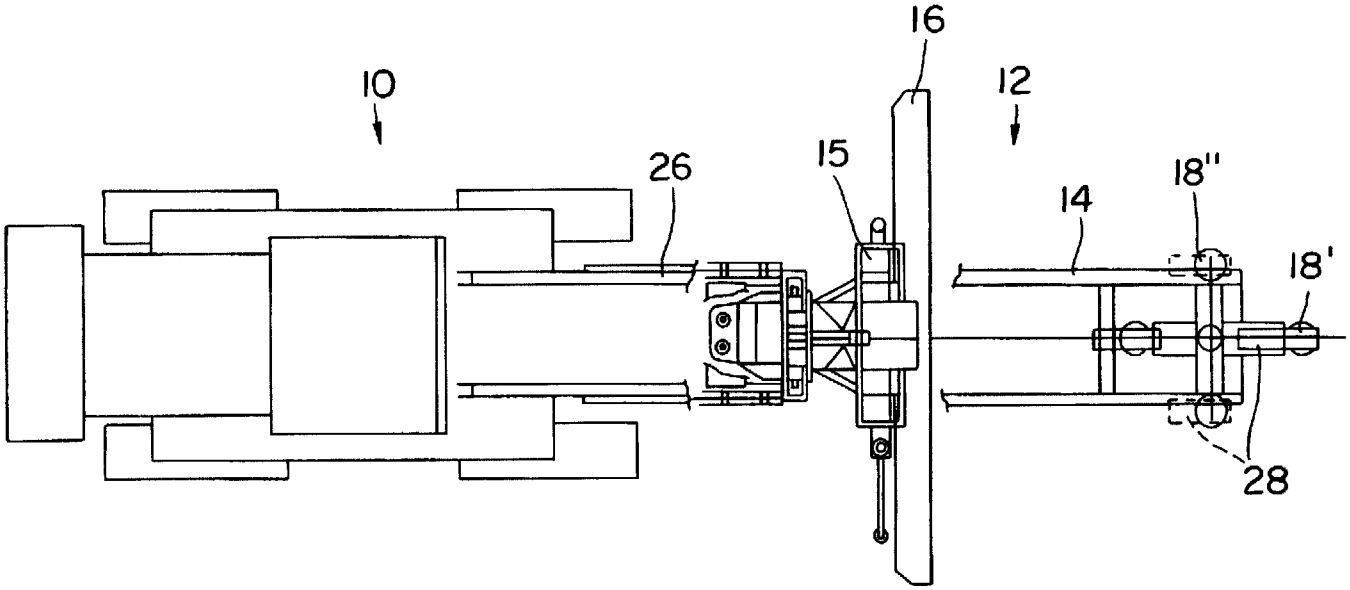
FIG. 4 is a view from above of the apparatus according to FIG. 1.
Figure 7:
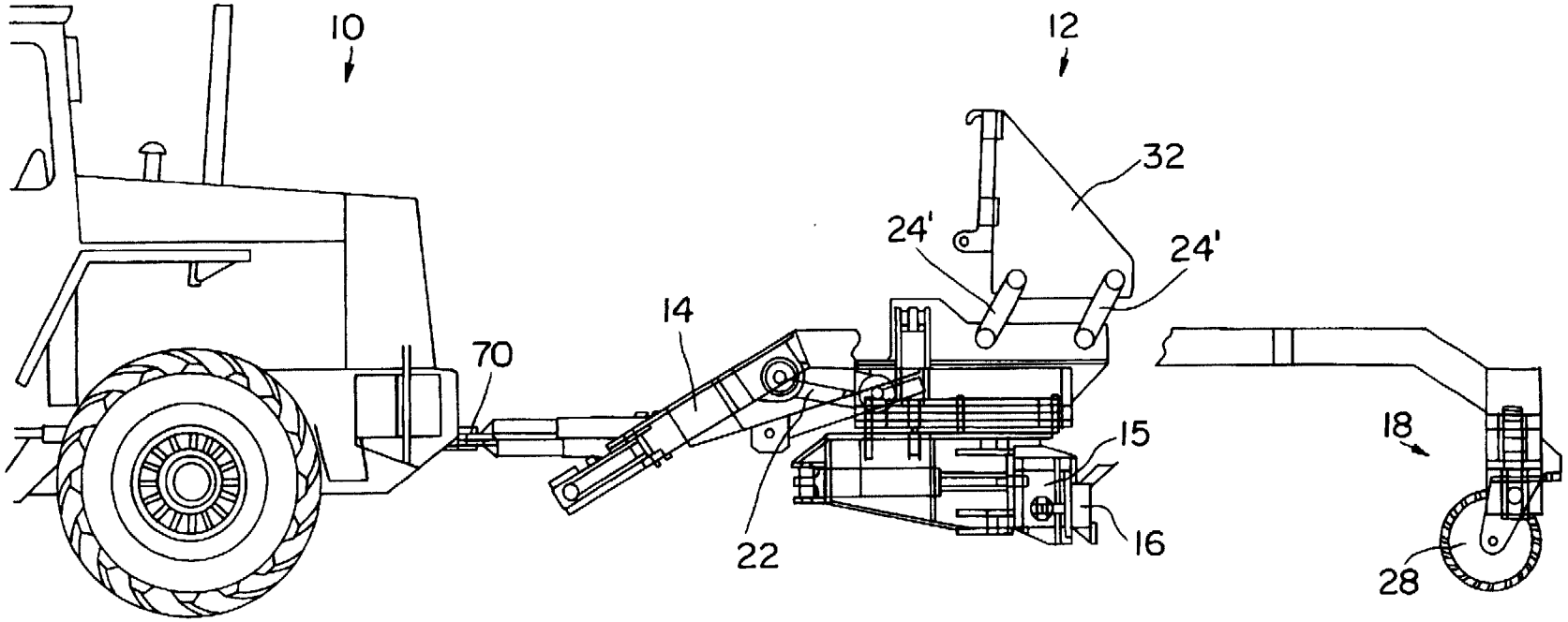
FIG. 7 is a side view of the inventive apparatus in the transport position.

FIG. 1 is a side view of a machine 10, such as a wheel-mounted loader to which an inventive apparatus 12 is coupled. The apparatus 12 includes a frame 14 which can be coupled removably to the machine 10 and which extends rearwardly from the machine 10 in its normal direction of movement, and further includes a planing or grading tool 16. Mounted on the front end of the frame 14 is a bogie-assembly 18 which can be adjusted between two positions, i.e. a working position (18', c.f. FIG. 4) and a transport position (18", c.f. FIGS. 4 and 7). The bogie-assembly 18 comprises a bogie-beam 30 and two pivotable wheels 28. FIG. 1 shows the apparatus 12 and the bogie-assembly 18 in their working positions, in which the bogie-beam 30 extends parallel with the frame 14. The bogie-beam 30 is pivotally mounted to the frame 14, and consequently an irregularity in the ground surface, or machine running surface, of ×mm in the vicinity of the foremost wheel 28 will increase the height of the frame 14 at the attachment point of the bogie-beam 30 by only ×/2 mm. The two pivotal wheels 28 can be rotated through 360° around their points of attachment to the bogie-beam 30. The apparatus 12 also includes an implement unit 15 on which the planing tool 16 is mounted, and an intermediate unit 20 mounted adjacent the implement unit 15. The apparatus 20 can also be connected removably to the lifting arms 26 of the machine 10, these arms also being pivotally connected to the intermediate unit 20. The inventive apparatus 12 also includes a link device 22 which is pivotally mounted to the frame 14 and also to the intermediate unit 20. FIG. 2 is a side view which shows the construction of the planing yoke in larger scale, said yoke forming part of the apparatus 12 shown in FIG. 1. As shown in FIG. 2, a parallelogram-mechanism generally referenced 24 includes an attachment or coupling device 32 for attachment to the lifting arms of the machine 10 (only a part of which arms are shown in FIG. 2) and two link arms 24' which are pivotally mounted to the attachment device 32 and to the intermediate unit 20.

Figures 3A, 3B, 3C:
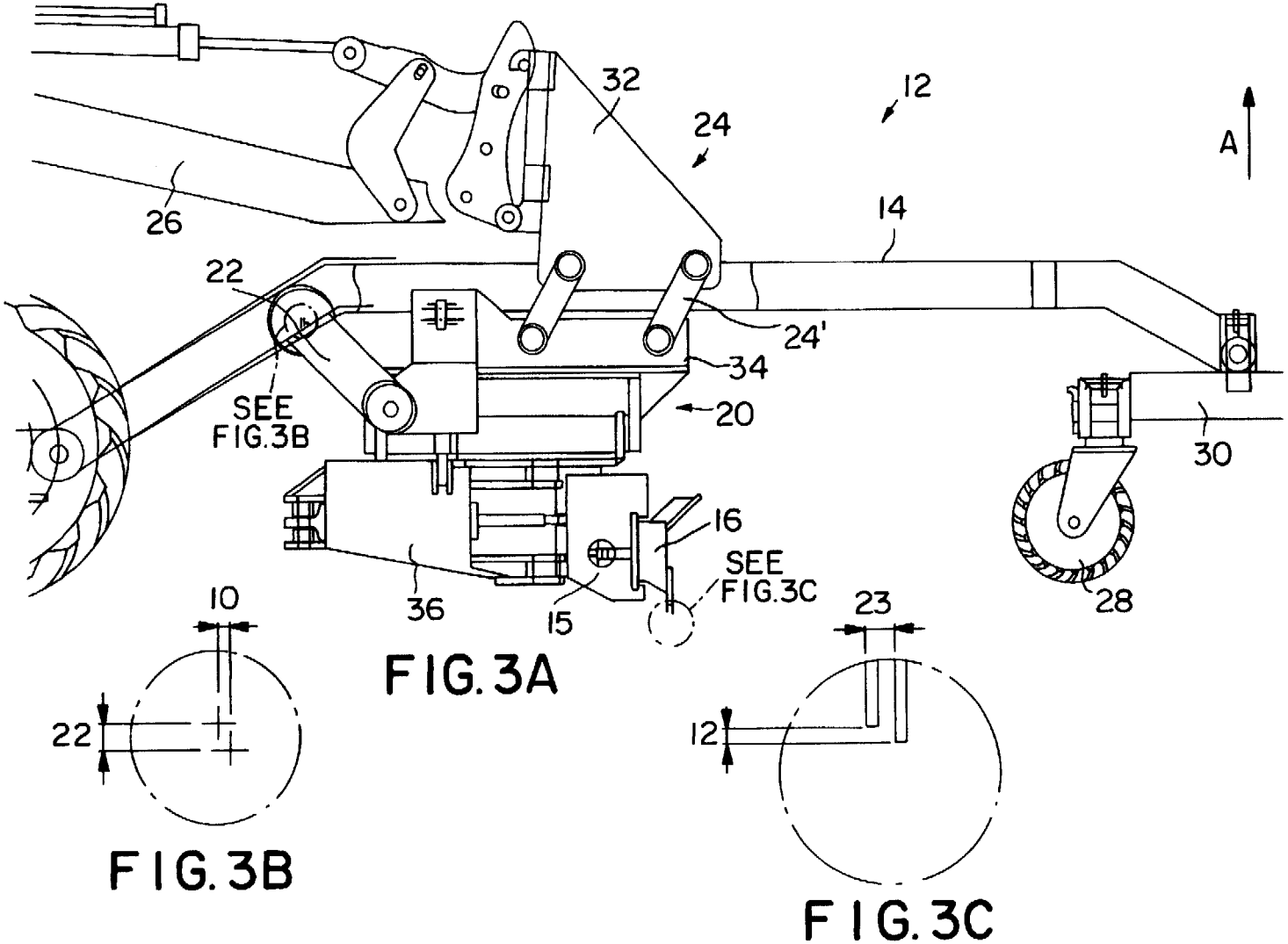
FIG. 3 is a side view of the apparatus according to FIG. 1 and is intended to explain the ability of the apparatus to equalize the effect of ground-surface irregularities.

FIG. 3 is a side view of the apparatus according to FIG. 1 and is intended to illustrate the ability of the apparatus to equalize the effect of irregularities in the ground surface or machine running surface. If it is assumed that the ground surface has an irregularity which is 200 mm in height, the frame 14 will be "lifted" at the bogie-assembly 18 through a distance of 100 mm (A), as the front pivot wheel 28 passes over the irregularity. This is made possible by the construction of the bogie-assembly 18. As will be seen at (B) in FIG. 3, the link device 22 is "lifted" through a distance of 22 mm. The original irregularity of 200 mm has been reduced to 12 mm in the vicinity of the planing or grading tool 16, which is the "lift" at the planing or grading tool 16 (compare (C) in FIG. 3). These values are obtained provided that the planing tool 16 is not influenced by the hydraulic piston-cylinder devices provided for adjusting the tool settings. This ability to equalize the effect of ground-surface irregularities is obtained, among other things, because the machine 10, the lifting arm 26, the parallelogram mechanism 24, the intermediate part 20, the link device 22 and the frame 14 are so arranged as to form a closed loop in said apparatus, meaning that the parallelogram mechanism 24 has no direct connection with the frame 14. As will be seen from FIG. 3, the intermediate unit 20 comprises two parts, i.e. a first intermediate part 34 which is connected to the link device 22 and the parallelogram mechanism 24, and a second intermediate part 36 which is located adjacent the implement unit 15 and the first intermediate part 34. One contributory factor towards reducing the transmission of a ground surface irregularity to the planing tool 16 is that the link device 22 is attached pivotally to the frame 14 and also to the first intermediate part 34, and that the two link arms 24' of the parallelogram mechanism 24 are pivotally attached to the attachment device 32 and to the first intermediate part 34, which means that the parallelogram mechanism 24 will always form a parallelogram, i.e. the link arms 24' will always be parallel, irrespective of how the apparatus is influenced by ground-surface irregularities. This means that the angle of the planing tool 16 relative to the ground surface or machine running surface will not change when meeting surface irregularities. Because the attachment device 32 is connected to the lifting arms 26, tilting movement of the machine 10 can be used to influence angling of the planing toot 16 relative to the ground surface.

FIG. 4 is a view of the apparatus in FIG. 1 from above. In FIG. 4, the reference sign 18' identifies the working position of the bogie-assembly 18, whereas the reference sign 18' identifies the transport position of the bogie-assembly 18 (compare FIG. 1 and FIG. 7 respectively).

Figure 5B:
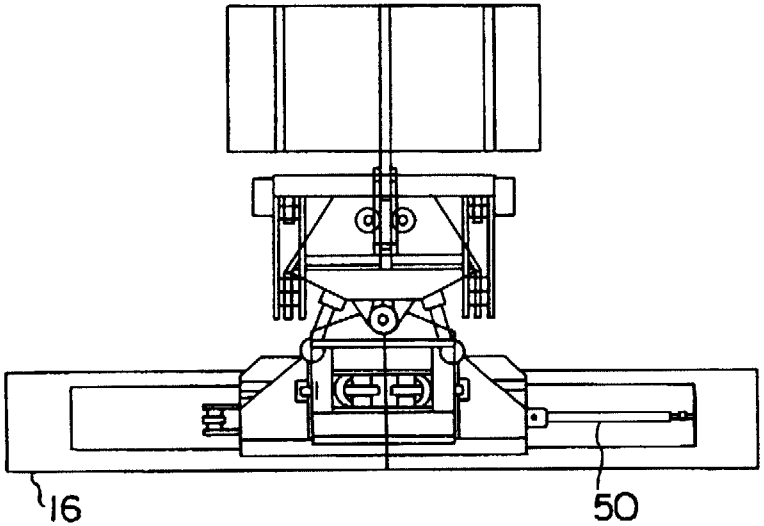
FIGS. 5 A and B are views from above of part-of-the inventive apparatus and are intended to illustrate lateral displacement of the planing tool.
Figure 5A:
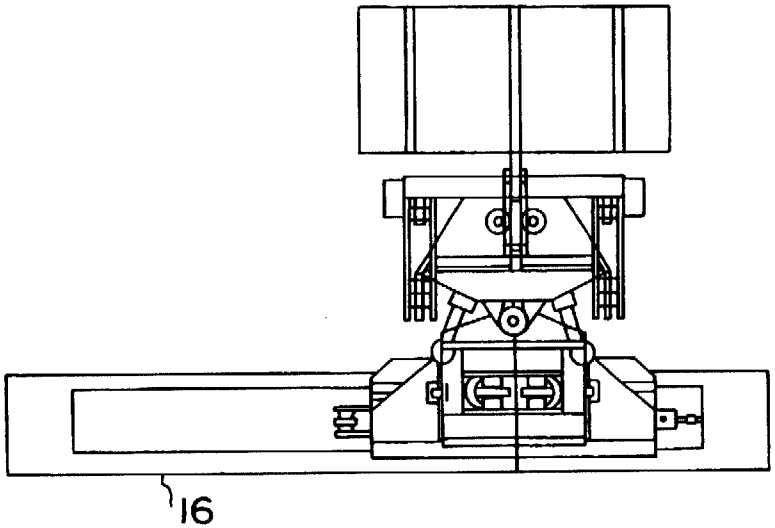

FIGS. 5 A and B are views from above of part of the inventive apparatus and are intended to illustrate lateral displacement of the planing tool 16. It will be seen from FIG. 5 A that a hydraulic piston-cylinder device 50 is mounted between the planing tool 16 and the implement unit 15, this hydraulic device being used to move the planing tool 16 sideways. FIG. 5 A shows the planing tool 16 in a centred position, while FIG. 5 B shows the tool 16 displaced maximally to the left.? The planing tool 16 can also be moved equally as far to the right.

Figure 6B:
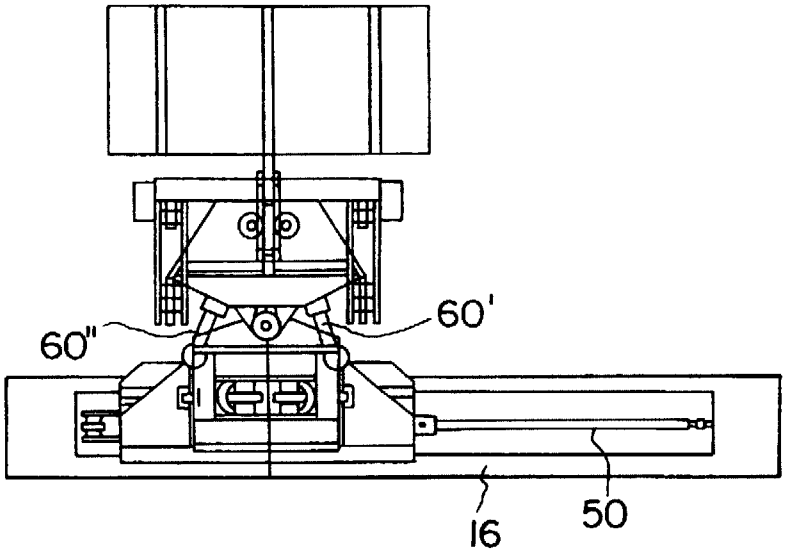
FIGS. 6 A and B are views from above of part of the inventive apparatus and are intended to illustrate oscillatory movement of the planing tool in a flat position.
Figure 6A:
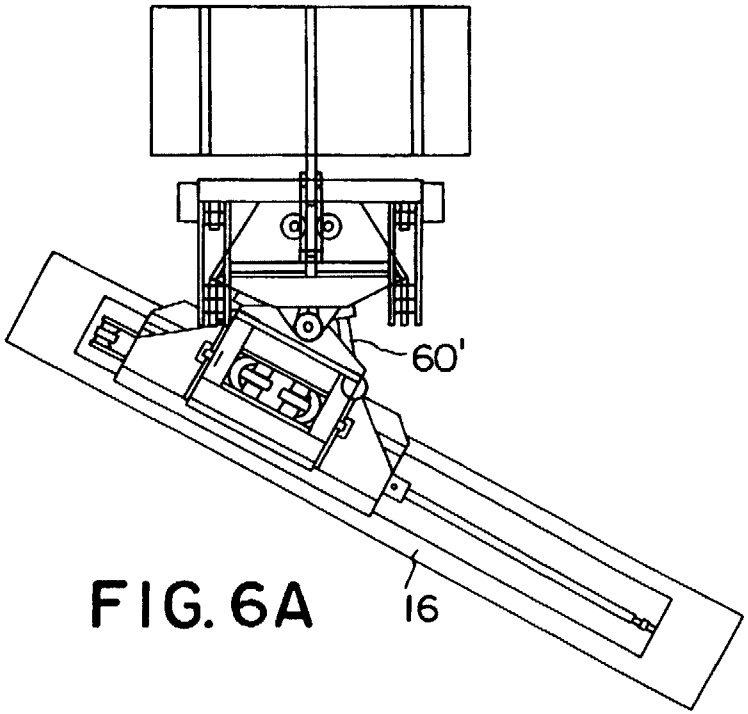

FIGS. 6 A and B are views from above of a part of the inventive apparatus and are intended to illustrate swinging of the tool 16 in a flat position. As will be seen from FIG. 6, the inventive apparatus also includes two hydraulic piston-cylinder devices 60" and 60' mounted between the second intermediate part 36 and the implement unit 15. The planing tool 16 is swung by activation of the hydraulic piston-cylinder devices 60" and 60'. FIG. 6 B shows maximum swinging of the planing tool 16.

FIG. 7 is a side view illustrating the inventive apparatus in its transport position. In order to enable the apparatus 12 to be switched between the working position shown in FIG. 7 and the transport position shown in FIG. 7, the apparatus includes a downwardly swingable supportive device (not shown) which in the working position of the apparatus is swung down so as to rest against the ground surface. The apparatus 12 is then disconnected from the machine 10. The bogie-assembly 18 is also adjusted in the transport position, i.e. with the bogie-beam 30 placed transversely across the frame 14. The apparatus 12 is then connected to a coupling point 70 on the machine 10. As illustrated in FIG. 7, the apparatus 12 is towed behind the machine 10 when in its transport position.

The link arms 24' shown in FIG. 3 and included in the parallelogram mechanism 24 may also be replaced with hydraulic piston-cylinder devices which fulfil the same function.

As will be understood, the aforedescribed technique is not solely applicable to wheel-mounted loaders, but can also be applied to conventional road planers or graders.

The following comparison is made with the intention of further illustrating the advantages afforded by the present invention- Assume that the front wheels of a conventional road planar pass over an irregularity having a height of 50 mm and with the planing blade unadjusted. The result would be that 27 mm of the irregularity would remain in the ground surface subsequent to planing the surface. When practicing the inventive technique, only 1.7 mm of a 50 mm irregularity would remain after planing the surface.

It will be understood that the aforedescribed and illustrated embodiment of the invention do not limit the scope of the invention and that the scope of the invention is determined by the scope of the following claims.

I claim:

1. An apparatus for coaction with a machine that moves along ground surface, for equalizing the effect of irregularities in the ground surface, said apparatus comprising a frame disposed in movement direction of the machine, a planing tool, a bogie-assembly mounted on and parallel to front end of the frame, two pivotal wheels, and a linking device pivotally mounted between the frame and an intermediate unit connected to the planing tool.

2. An apparatus according to claim 1, further comprising a parallelogram mechanism mounted between a lifting arm on the machine and the intermediate unit.

3. An apparatus according to claim 2, wherein the bogie-assembly includes a bogie-beam for carrying one of the two pivot wheels on each end thereof; and wherein the bogie-assembly is adjustable between a working position in which the bogie-beam is parallel to the frame and a transport position in which the bogie-beam is perpendicular to the frame (14).

4. An apparatus according to claim 3, further comprising an implement unit mounted adjacent to the intermediate unit for carrying the planing tool; wherein the machine, the lifting arm, the parallelogram mechanism, the intermediate unit, the linking device and the frame are arranged so as to form a closed loop, and wherein the parallelogram mechanism is not connected to the frame.

5. An apparatus according to claim 4, wherein said apparatus is an auxiliary device removably connected to the machine via the frame and an attachment device forming part of the parallelogram mechanism.

6. An apparatus according to claim 5, wherein the linking device is pivotally mounted to the frame and the intermediate unit; wherein the parallelogram mechanism includes two mutually parallel linking means pivotally attached to the attachment device and the intermediate unit, and wherein the angle of the planing tool relative to the ground surface remains unchanged when passing over irregularities in the ground surface.

7. An apparatus according to claim 6, wherein the attachment device is connectable to the lifting arm so as to enable tilting movement of the machine in relation to the ground surface.

8. An apparatus according to claim 7, wherein the pivot wheels are rotatable through 360° in relation to the bogie-beam.

9. An apparatus according to claim 8, wherein the intermediate unit includes two parts: a first intermediate part connected to the linking device and the parallelogram mechanism, and a second intermediate part mounted adjacent to the implement unit and the first intermediate part.

10. An apparatus according to claim 5, wherein the auxiliary device is fixedly attached to a wheel-mounted loader.

11. An apparatus according to claim 6, wherein the linking means includes hydraulic piston-cylinder devices.

12. An apparatus according to claim 1, wherein the machine is selected from the group consisting of a wheel-mounted loader, road planer and road grader.

* * * * *